US006975310B1

(12) United States Patent
Seth

(10) Patent No.: US 6,975,310 B1
(45) Date of Patent: Dec. 13, 2005

(54) FADE CONTROLLER FOR PROVIDING PROGRAMMABLE FADE RATES FOR ON-SCREEN DISPLAY (OSD) WINDOW

(75) Inventor: Mohammad K. Seth, Fremont, CA (US)

(73) Assignee: National Semiconductor Corporation, Santa Clara, CA (US)

( * ) Notice: Subject to any disclaimer, the term of this patent is extended or adjusted under 35 U.S.C. 154(b) by 379 days.

(21) Appl. No.: 10/614,228

(22) Filed: Jul. 7, 2003

(51) Int. Cl.[7] ..... G09G 5/00

(52) U.S. Cl. ..... 345/204; 348/595; 715/803; 715/715; 715/816

(58) Field of Search ..... 345/204, 698, 345/699; 348/595; 715/716, 764, 803, 804, 715/815

(56) References Cited

U.S. PATENT DOCUMENTS

| | | | | |
|---|---|---|---|---|
| 6,493,005 | B1 * | 12/2002 | Wu | 715/804 |
| 6,587,155 | B1 * | 7/2003 | Xue | 348/595 |
| 6,606,100 | B1 | 8/2003 | Lonoce et al. | |
| 2002/0149626 | A1 * | 10/2002 | Ozcelik et al. | 345/781 |

* cited by examiner

*Primary Examiner*—Lun-Yi Lao
*Assistant Examiner*—Michael Pervan
(74) *Attorney, Agent, or Firm*—Vedder Price Kaufman & Kammholz, P.C.

(57) ABSTRACT

A fade controller for providing programmable fade rates for an on-screen display (OSD) window within a video display. Simple digital circuitry is used to control the size and dimensions of the OSD window and the rates at which it opens vertically and horizontally for fade in or closes vertically and horizontally for fade out, or both.

18 Claims, 4 Drawing Sheets

A = active_1
FIE = FEN & OSD_ENABLE & Window1_Enable
FOE = FEN & (OSD_ENABLE | WINDOW1_ENABLE)
FOA = FOE & A
H = Win1_is _on (set on start of Win1 & cleared on line_beg-le Or start of Win2)
O = H & OSD_ON
FI = FEN & O
OVR = h_accum – HINTVL <= 0

S = FIE & V & HINTVL !=0
TC = h_count_tc
V = vflyback_sl & line_beg_le
VDN = Vertical Fade Out Done A = active_1
FIE = FEN & OSD_ENABLE & Window1_Enable
FOE = FEN & (OSD_ENABLE | WINDOW1_ENABLE)
FOA = FOE & A
FI = FEN & O
OVR = V_accum – VINTVL <= 0
S = FIE & V INTVL !=0
TC = v_count_tc
V = vflyback_sl & line_beg_le
HDN = H_state_done

FADE CONTROLLER FOR PROVIDING PROGRAMMABLE FADE RATES FOR ON-SCREEN DISPLAY (OSD) WINDOW

BACKGROUND OF THE INVENTION

1. Field of the Invention

The present invention relates to circuitry for controlling the display of an on-screen display (OSD) window within a video display, and in particular, to fade control circuitry for providing fade in and fade out control over an OSD window.

2. Description of the Related Art

Referring to FIG. 1, as video display devices have increased in complexity and sophistication, particularly computer monitors, it is increasingly common for the display 10 in which a video image 12 is displayed to also include an OSD region, or window, 20 in which OSD information is displayed, such as one or more lines of OSD characters. One feature which has become increasingly popular is fading of the OSD window 20, whereby the vertical 20*v* and 20*h* dimensions of the OSD window 20 are selectively increased (fade in) or decreased (fade out) when opening or closing, respectively, the OSD window 20. This is typically done by initiating the opening and terminating the closing at the top left corner 20*c* of the OSD window 20. Between its fully closed and fully opened states, the OSD window will have a number of intermediate sizes as indicated by the dashed lines 20*vi*, 20*hi* representing the intermediate vertical and horizontal dimensions of such intermediate windows.

Opening or closing of the OSD window 20 is normally timed to be less than one second, e.g., approximately 0.5 second. The time intervals for the opening or closing of the window 20 in the horizontal and vertical directions can be fixed, or variable dependent upon the size of the window 20. While fixing such time interval would make the implementation of the control circuitry for doing this a simpler task, the size and shapes of OSD windows 20 are often variable. Accordingly, using fixed time intervals would cause the opening and closing times for a small OSD window to be faster than for a larger window. Hence, for a small OSD window, the resulting fade in and fade out effects would appear minimal.

SUMMARY OF THE INVENTION

In accordance with the presently claimed invention, a fade controller provides programmable fade rates for an on-screen display (OSD) window within a video display. Simple digital circuitry is used to control the size and dimensions of the OSD window and the rates at which it opens vertically and horizontally for fade in or closes vertically and horizontally for fade out, or both.

In accordance with one embodiment of the presently claimed invention, a fade controller for providing programmable fade rates for an OSD window within a video display includes accumulation circuitry, counting circuitry and encoding circuitry. The accumulation circuitry responds to reception of a plurality of accumulation control signals and respective programmable vertical and horizontal fade interval data signals corresponding to respective programmable vertical and horizontal OSD fade intervals by providing respective pluralities of cumulative vertical and horizontal fade interval data signals corresponding to respective pluralities of cumulative vertical and horizontal OSD fade intervals. The counting circuitry, coupled to the accumulation circuitry, responds to reception of a plurality of timing control signals and the pluralities of cumulative vertical and horizontal fade interval data signals by providing vertical and horizontal count signals corresponding to respective completions of the cumulative vertical and horizontal OSD fade intervals. The encoding circuitry, coupled to the counting circuitry, responds to reception of a plurality of OSD window control signals and the vertical and horizontal count signals by providing an OSD fade control signal corresponding to occurrence of the OSD window within the video display.

In accordance with another embodiment of the presently claimed invention, a fade controller for providing programmable fade rates for an OSD window within a video display includes accumulator means, counter means and encoder means. The accumulator means is for receiving a plurality of accumulation control signals and respective programmable vertical and horizontal fade interval data signals corresponding to respective programmable vertical and horizontal OSD fade intervals and in response thereto generating respective pluralities of cumulative vertical and horizontal fade interval data signals corresponding to respective pluralities of cumulative vertical and horizontal OSD fade intervals. The counter means is for receiving a plurality of timing control signals and the pluralities of cumulative vertical and horizontal fade interval data signals and in response thereto generating vertical and horizontal count signals corresponding to respective completions of the cumulative vertical and horizontal OSD fade intervals. The encoder means is for receiving a plurality of OSD window control signals and the vertical and horizontal count signals and in response thereto generating an OSD fade control signal corresponding to occurrence of the OSD window within the video display.

In accordance with still another embodiment of the presently claimed invention, a method of fade control for applying programmable fade rates to an on-screen display (OSD) window within a video display includes:

- vertically fading the OSD window using a programmable vertical OSD interval value corresponding to a vertical dimension of the OSD window; and
- horizontally fading the OSD window using a programmable horizontal OSD interval value corresponding to a horizontal dimension of the OSD window;
- with each of the fadings performed by
  - providing the programmable OSD interval value;
  - storing the programmable OSD interval value;
  - enabling the OSD window;
  - counting during a time interval corresponding to the stored OSD interval value;
  - disabling the OSD window following termination of the time interval count;
  - combining the programmable and stored OSD interval values to provide a cumulative OSD interval value;
  - substituting the cumulative OSD interval value for the stored OSD interval value;
  - repeating the enabling, counting, disabling, combining and substituting until a predetermined cumulative OSD interval value has been reached.

DETAILED DESCRIPTION OF THE INVENTION

Figure 1:
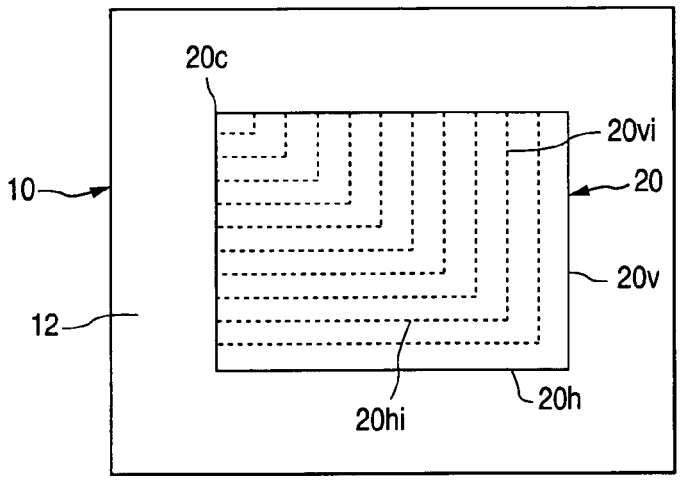
FIG. 1 is a diagram illustrating the display of an OSD window within a video display.

The following detailed description is of example embodiments of the presently claimed invention with references to the accompanying drawings. Such description is intended to be illustrative and not limiting with respect to the scope of the present invention. Such embodiments are described in sufficient detail to enable one of ordinary skill in the art to practice the subject invention, and it will be understood that other embodiments may be practiced with some variations without departing from the spirit or scope of the subject invention.

Throughout the present disclosure, absent a clear indication to the contrary from the context, it will be understood that individual circuit elements as described may be singular or plural in number. For example, the terms "circuit" and "circuitry" may include either a single component or a plurality of components, which are either active and/or passive and are connected or otherwise coupled together (e.g., as one or more integrated circuit chips) to provide the described function. Additionally, the term "signal" may refer to one or more currents, one or more voltages, or a data signal. Within the drawings, like or related elements will have like or related alpha, numeric or alphanumeric designators. Further, while the present invention has been discussed in the context of implementations using discrete electronic circuitry (preferably in the form of one or more integrated circuit chips), the functions of any part of such circuitry may alternatively be implemented using one or more appropriately programmed processors, depending upon the signal frequencies or data rates to be processed.

When using a fixed interval for the fading in and fading out of the OSD window, such interval can be determined by establishing the total fade in or fade out time interval and the typical size of the OSD window. For example, a common size for a single OSD character is twelve pixels in width and eighteen lines in height. Accordingly, by knowing how many characters are to be available for each horizontal line and how many lines of characters are to be available, the size of the OSD window can be readily determined. By fixing the number of pixels and lines to be opened or closed during each vertical field or scan, appropriate circuitry can be readily implemented. However, as noted above, using a fixed interval is may be undesirable when variable OSD window sizes are possible.

To determine the appropriate horizontal fade interval, the horizontal dimension in pixels would be divided by the product of the average fade (in and out) time and the average vertical scan rate. Similarly, for the appropriate vertical fade interval, the vertical dimension in lines would be divided by the product of the average fade (in and out) time and the average vertical scan rate.

For example, for a fade (in/out) time of one second and a vertical scan rate of 60 Hertz, the horizontal and vertical intervals can be computed as follows. For a horizontal dimension of 600 pixels, the horizontal interval would equal 600/(1.0*60)=10 pixels, while for a vertical dimension of 480 lines, the vertical interval would equal 480/(1.0*60)=8 lines. Accordingly, four bits for the vertical and horizontal interval number would be sufficient. For even more control on fade in/out speed, the register used for the interval data can be increased, e.g., an eight-bit register.

Figure 2:
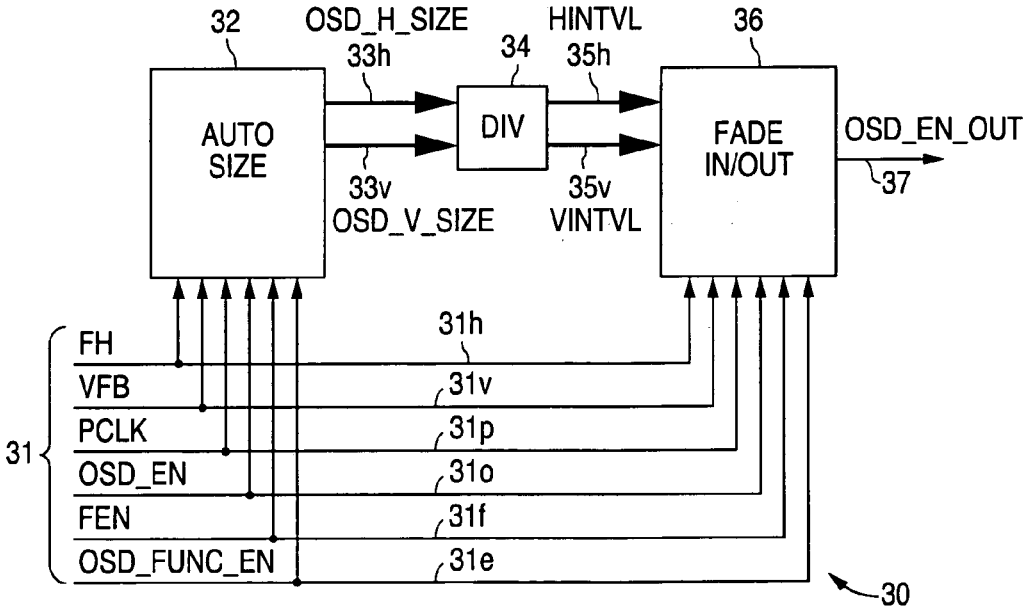
FIG. 2 is a functional block diagram of that portion of a video display system employing a fade controller in accordance with the presently claimed invention.

Referring to FIG. 2, using the more desirable variable fade interval requires determining the size of the OSD window. For implementation in hardware, an auto-size functional stage 32 determines the size of the OSD window by monitoring pertinent timing signals within the video display system; horizontal flyback 31*h*; vertical flyback 31*v*; pixel clock 31*p*; OSD enable 31*o*; fade (in/out) enable 31*f*; and a master OSD function enable 31*e*.

The resulting horizontal 33*h* and vertical 33*v* size data are then divided in a divider stage 34 by the desired interval value and average vertical scan rate (as noted above) to produce the appropriate horizontal 35*h* and vertical 35*v* interval data. As discussed in more detail below, the fade in/out stage 36 then uses these horizontal 35*h* and vertical 35*v* interval data to produce the appropriate OSD fade control signal 37.

Such an auto-sizing stage 32 can be implemented in any of a number of well known conventional ways. Alternatively, the auto-sizing functional stage 32 can be implemented in firmware by using some form of computational stage (e.g., microprocessor or microcontroller) to perform the above-discussed computations needed to produce the horizontal 35*h* and vertical 35*v* interval data.

An additional advantage of having separately programmable interval numbers is the possibility for different fade in and fade out effects, such as horizontal fade only, vertical fade only, or both. For example, for vertical fade only, the horizontal register would be loaded with an interval data value of zero and the remaining hardware would detect this condition and immediately open the OSD window horizontally in full. Similarly, for horizontal fade only, the vertical interval data would be programmed with a zero value, and the OSD window would immediately open vertically in full.

Figure 3:
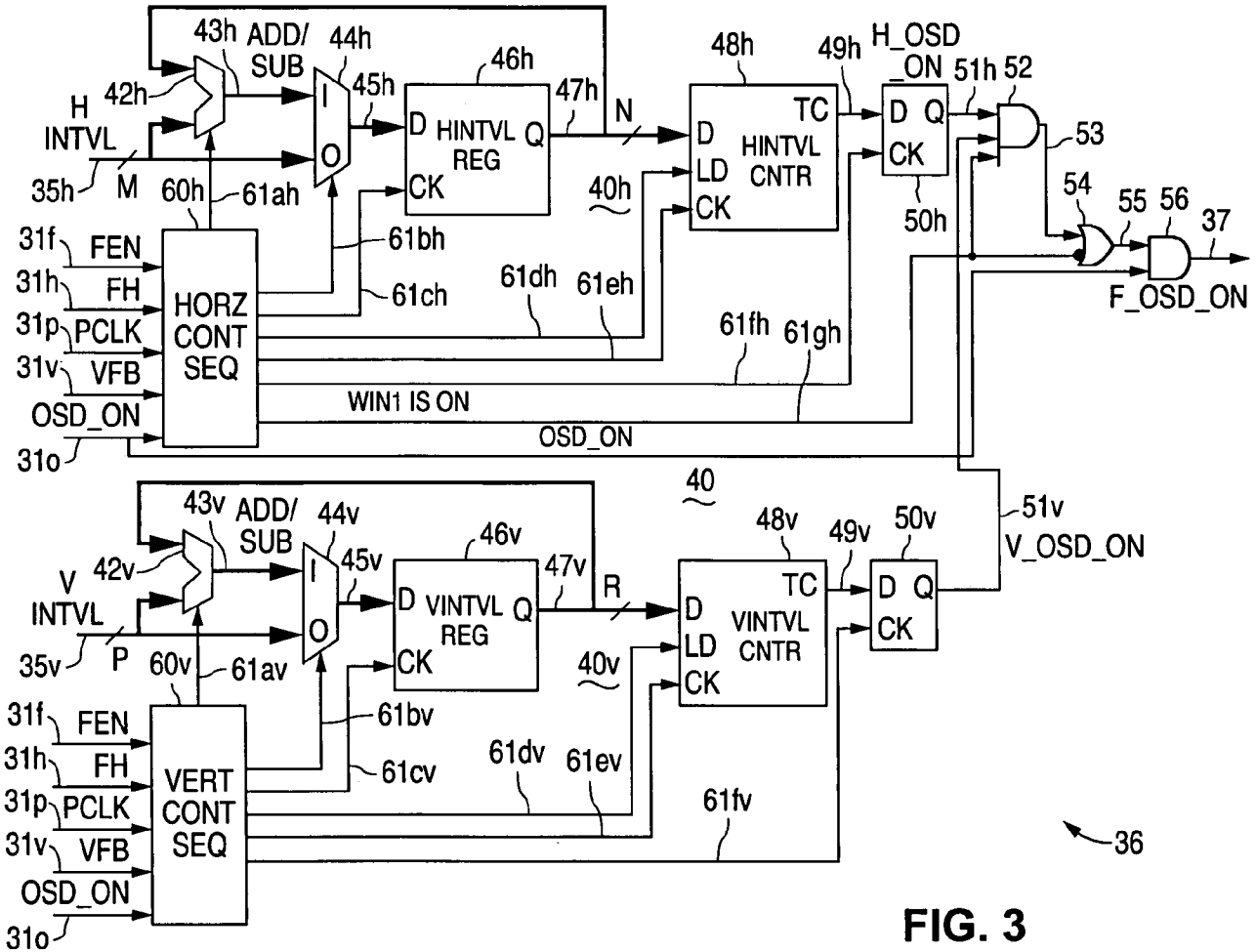
FIG. 3 is a functional block diagram of a fade controller in accordance with one embodiment of the presently claimed invention.

Referring to FIG. 3, a fade controller 36 in accordance with the presently claimed invention includes fade control circuitry 40 and horizontal 60*h* and vertical 60*v* control sequencing circuitry. In turn, the fade control circuitry 40 includes horizontal fade control circuitry 40*h* and vertical fade control 40*v*. As discussed in more detail below, the horizontal control sequencer 60*h* and vertical control sequencer 60*v* provide various control and timing signals 61*h*, 61*v* for the horizontal 40*h* and vertical 40*v* fade control circuitry, respectively.

Each of the horizontal 40*h* and vertical 40*v* fade control circuits includes a digital adder 42, a signal router (e.g., switch or multiplexor) 44*h*, a multi-bit register 46, a counter 48 and a latch 50, all interconnected substantially as shown. In each circuit 40*h*, 40*v*, the incoming programmable interval data 35 (M bits for the horizontal interval data 35*h* and P bits for the vertical interval data 35*v*) are received by the adder 42 and router 44. The routed, or selected, data 45 is stored in the register 46. The stored data 47 is fed back to the other input of the adder 42 and is also loaded into the counter 48.

Control signal 61*a* from the sequencer 60 determines whether the adder 42 is used to find the sum of or take the difference between the programmable interval data 35 and the previously stored data 47. These data 35, 47 are added for fade in, and are subtracted (e.g., programmable data 35 subtracted from stored cumulative data 47) for fade out.

Control signal 61*b* selects between the programmable interval data 35 and the combined (added or subtracted) data 43 and provides such selected data 45 to the register 46 for storage as cumulative data 47. Control signal 61*b* is initially inactive (e.g., de-asserted) to cause the incoming interval data 35 to be loaded into the register 46. Subsequently, it becomes active (e.g., asserted) so as to allow the data 47 stored in the register 46 to become cumulative based upon the operation of the adder 42.

A clocking, or loading, signal 61*c* for the register 46 is active in relation to the vertical flyback signal 31*v*, and becomes inactive once the maximum OSD dimension (horizontal or vertical) has been reached.

Control signal 61*d* loads the stored cumulative data 47 into the counter 48. Control signal 61*dh* for the horizontal circuitry 40*h* is related to the horizontal feedback signal 31*h*, while control signal 61*dv* for the vertical circuitry 40*v* is related to the vertical flyback signal 31*v*. Control signal 61*e* clocks the counter 48 which, upon completing its count, activates its terminal count output signal 49. Control signal 61*eh* for the horizontal circuitry 40*h* is related to the pixel clock signal 31*p*, while control signal 61 *ev* for the vertical circuitry 40*v* is related to the horizontal flyback signal 31*h*.

In a preferred embodiment, the counter circuitry 48 is a down counter and the terminal count signal 49 is active, e.g., asserted, upon the attainment of a zero count. However, it will be appreciated that, if the complement of the stored cumulative data 47 is available for use by the counter 48, such counter 48 can also be an up counter with the terminal count signal 49 becoming active following attainment of a maximum count value.

The terminal count signal 49 is latched by the latch circuitry 50 in accordance with its clock signal 61*f*, where both clock signals 61*fh*, 61*fv* are frequency-divided versions (e.g., one-fourth) of the pixel clock signal 31*p*.

The resulting latched signals 51*h*, 51*v* are logically ANDed with each other and control signal 61*gh*. When asserted, this control signal 61*gh* indicates that the OSD window is to be faded (in/out), as opposed to being fixed. The resulting ANDed signal 53 is logically ORed with the inverse of control signal 61*gh*. Accordingly, during assertion of this control signal 61*gh*, the enabled combination of the two latched signals 51*h*, 51*v* effectively passes through the OR gate 54 to become a fade enablement signal 55 which is itself enabled by the OSD enablement signal 31*o* in an output AND gate 56, thereby producing the final OSD fade enablement signal 37.

Hence, in conformance with the foregoing discussion, each of the horizontal 40*h* and vertical 40*v* fade control circuits operates as follows. The incoming programmable interval data 35 is routed by the router 44 and initially stored in the register 46. This stored data 47 is used by the counter 48 to establish the initial fade interval. For fade in, this initial fade interval is the minimum interval, while for fade out, this initial interval is the maximum interval. During the next vertical scan interval, the stored interval data 47 is fed back and combined with a programmable interval data 35 (summed for fade in and subtracted for fade out), with the resulting combined interval data 43 being routed by the router 44 to the register 46 for storage as cumulative interval data 47. This newly computed cumulative interval data 47 is then used by the counter 48 to establish the next fade interval. This process continues until the maximum (fade in) or minimum (fade out) OSD dimension is reached.

Figure 4:
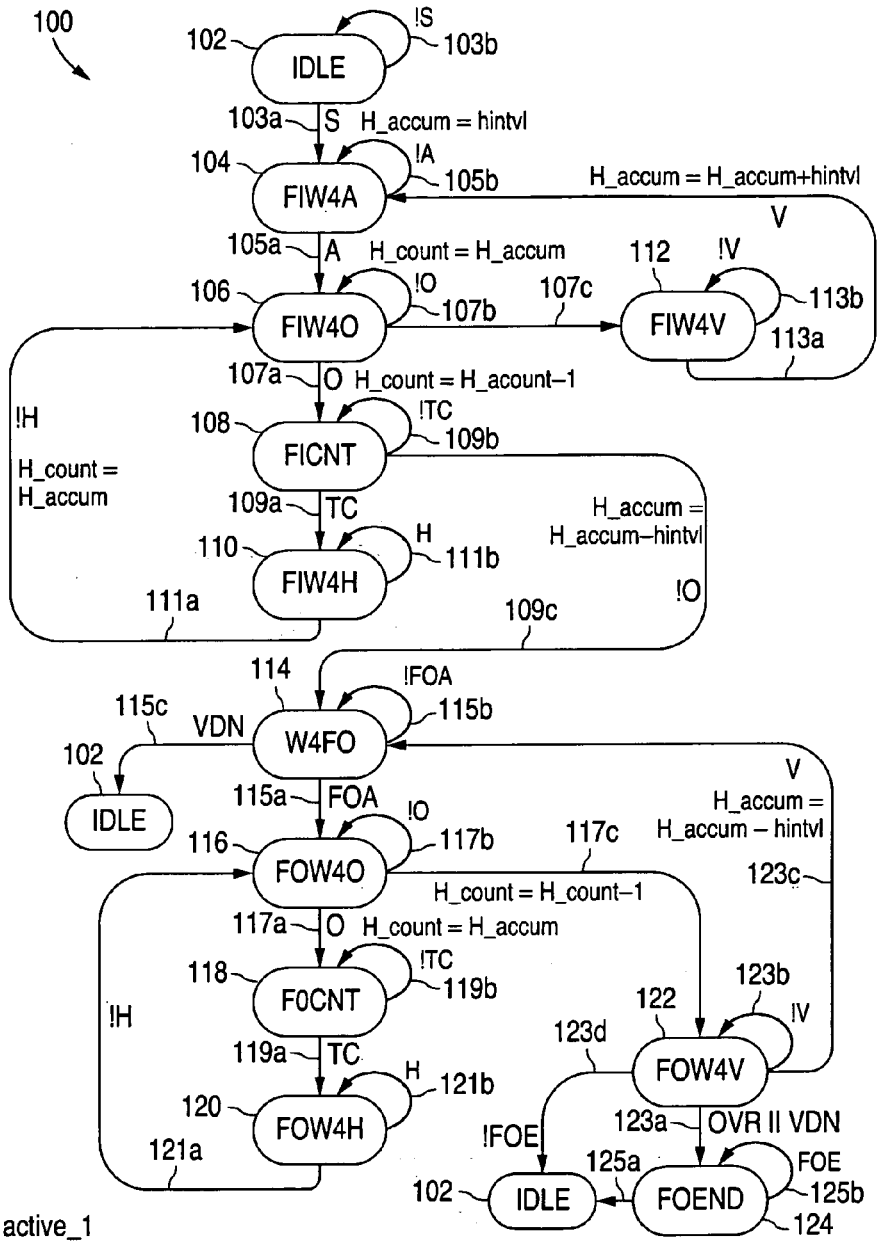
FIG. 4 is a state diagram depicting the states and transitions between states for the horizontal control sequencer in the circuit of FIG. 3.

The horizontal 60*h* and vertical 60*v* control sequencers can be implemented as state machines in accordance with well known techniques. Referring to FIG. 4, a state machine for implementing the horizontal control sequencer 60*h* includes a plurality of machine states 100 as follows. Operation begins with an idle state 102. Transition 103*a* occurs when fade in is enabled and the programmable horizontal interval data 35*h* is non-zero. If these conditions are not true, transition 103*b* occurs, thereby maintaining the idle state 102.

During state 104, fade in is enabled and the occurrence of an active OSD window is awaited. Transition 105*a* occurs when an active OSD window is to be faded, e.g., as when control signal 61*gh* (FIG. 3) is active. Meanwhile, until the OSD window is active, transition 105*b* occurs during which the stored interval data 47*h* remains equal to the original programmable data 35*h*.

During state 106, fade in remains enabled and an active OSD enablement signal is awaited. Upon enablement of a faded OSD window, transition 107*a* occurs. Until then, transition 107*b* occurs and the counter 48*h* is loaded with the stored interval data 47*h*. If no faded OSD window is to be displayed, transition 107*c* occurs, thereby placing the system in state 112.

During state 112, vertical flyback is awaited. Upon occurrence of vertical flyback, transition 113*a* occurs, horizontal interval data is accumulated and the system is returned to state 104. Meanwhile, until vertical flyback does occur, transition 113*b* causes the system to remain in state 112.

In state 108, the counter 48*h* performs its count function based upon the loaded interval data 47*h*. Upon the occurrence of terminal count, transition 109*a* occurs. Meanwhile, until terminal count is achieved, transition 109*b* occurs with the counter continuing its count sequence.

During state 110, the OSD window is not displayed. Transition 111*a* occurs when the OSD fade enablement signal becomes inactive, thereby causing the system to return to state 106 and the counter 48*h* to be reloaded with the accumulated interval data 47*h*. Until then, transition 111*b* occurs and the system remains in state 110.

During state 108, if either of the OSD enablement or faded OSD enablement signals become inactive, transition 109*c* occurs, the difference between the present accumulated interval data 47*h* and the programmable interval data 35*h* is substituted as the data for the counter 48*h* and the system enters state 114.

In state 114, the system awaits enablement of the fade out operation. Upon enablement of the fade out, transition 115*a* occurs. Meanwhile, transition 115*b* occurs, keeping the system in state 114. However, if vertical fade out is completed, transition 115*c* occurs and the system returns to the idle state 102.

During state 116, enablement of the OSD window is awaited. Upon such concurrence, transition 117*a* occurs. Meanwhile, transition 117*b* occurs, maintaining the system in state 116. However, if the OSD window is no longer vertically active, transition 117*c* occurs.

In state 118, the counter performs its count sequence. Upon attainment of terminal count, transition 119*a* occurs. Meanwhile, transition 119*b* occurs and the counter continues its count sequence.

In state 120, fade out has occurred and so long as the OSD fade function is enabled transition 121*b* maintains the system in state 120. Following disablement of the OSD fade function, transition 121*a* occurs, returning the system to state 116.

During state 122, fade out is enabled and vertical flyback is awaited. Transition 123*a* occurs if the difference between the accumulated interval data 47*h* and the programmable interval data 35*h* becomes zero or negative, or if vertical fade out has been completed, following which the system enters state 124. Otherwise, if vertical flyback has not yet occurred, transition 123*b* maintains the system in state 122. Upon occurrence of vertical flyback, transition 123*c* occurs, the difference between the accumulated interval data 47*h* and programmable interval data 35*h* is computed and stored, and the system returns to state 114. If fade out is no longer enabled, transition 123*d* occurs and the system returns to the idle state 102.

In state 124, fade out is completed. If fade out is no longer enabled, transition 125*a* returns the system to the idle state 102. Meanwhile, so long as fade remains enabled, transition 125*b* maintains the system in state 124.

Figure 5:
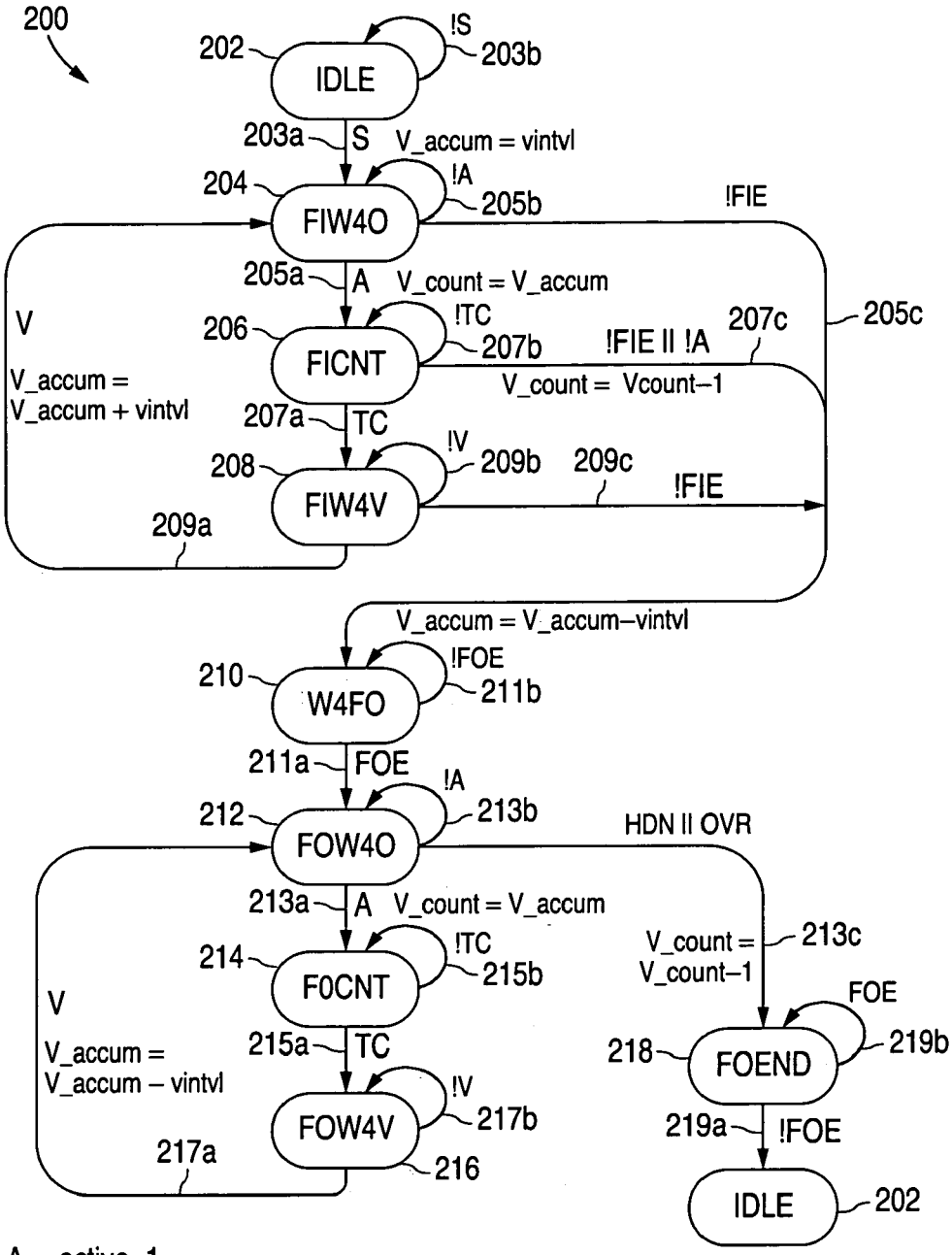
FIG. 5 is a state diagram depicting the states and transitions between states for the vertical control sequencer in the circuit of FIG. 3.

Referring to FIG. 5, a state machine for implementing the vertical sequencer 60*v* includes a plurality of machine states 200 as follows. The system begins in its idle state 202. Upon concurrence of enablement of the fade in function and non-zero programmable interval data 35*v*, transition 203*a* occurs. Until such concurrence, transition 203*b* maintains the system in its idle state 202.

In state 204, fade in is enabled and OSD enablement is awaited. Following enablement of the OSD window, transition 205*a* occurs. Until such enablement, transition 205*b* maintains the system in state 204 and the programmable vertical interval data 35*v* is stored in the register 46*v*. If the fade in function becomes disabled, transition 205*c* causes the system to enter state 210. During this transition 205*a*, the counter is loaded with the stored vertical interval data.

In state 206, the count sequence is initiated. Upon attainment of terminal count, transition 207*a* occurs. Until terminal count is attained, transition 207*b* occurs and the count sequence continues. In the event that the fade in function is disabled and the OSD window is no longer active, transition 207*c* occurs, causing the system to enter state 210.

In state 208, fade in is complete and vertical flyback is awaited. Following vertical flyback, transition 209*a* occurs, the accumulated 47*v* and programmable vertical interval 35*v* data are added, and the system returns to state 204. Meanwhile, pending vertical flyback, transition 209*b* maintains the system in state 208. In the event that the fade in function becomes disabled, transition 209*c* causes the system to enter state 210.

In state 210, enablement of the fade function is awaited. Following enablement, transition 211*a* occurs. Until such enablement, transition 211*b* maintains the system in state 210 and the difference between the accumulated 47*v* and programmable vertical interval 35*v* data is computed and stored.

In state 212, fade out is enabled and enablement of the OSD window is awaited. Once the OSD window becomes active, transition 213*a* occurs. During this transition 213*a*, the counter 48*v* is loaded with the stored vertical interval data 47*v*. Until then, transition 213*b* maintains the system in state 212. In the event that the horizontal state is completed and the difference between the accumulated and programmable vertical interval data is zero or negative, transition 213*c* occurs and the system enters state 218.

In state 214, fade out is initiated and the counter begins its count sequence. Upon attainment of terminal count, transition 215*a* occurs. Until terminal count is attained, transition 215*b* occurs and the count sequence continues.

In state 216, fade out is completed and vertical flyback is awaited. Following vertical flyback, transition 217*a* occurs, the difference between the previously stored 47*v* and programmable vertical interval 35*v* data is computed and stored as present accumulated data 47*v*, and the system returns to state 212.

In state 218, fade out is completed. Following disablement of the fade function, transition 219*a* returns the system to its idle state 202. Until then, transition 219*b* maintains the system in state 218.

Various other modifications and alternations in the structure and method of operation of this invention will be apparent to those skilled in the art without departing from the scope and the spirit of the invention. Although the invention has been described in connection with specific preferred embodiments, it should be understood that the invention as claimed should not be unduly limited to such specific embodiments. It is intended that the following claims define the scope of the present invention and that structures and methods within the scope of these claims and their equivalents be covered thereby.

What is claimed is:

1. An apparatus including a fade controller for providing programmable fade rates for an on-screen display (OSD) window within a video display, comprising:

accumulation circuitry that responds to reception of a plurality of accumulation control signals and respective programmable vertical and horizontal fade interval data signals corresponding to respective programmable vertical and horizontal OSD fade intervals by providing respective pluralities of cumulative vertical and horizontal fade interval data signals corresponding to respective pluralities of cumulative vertical and horizontal OSD fade intervals;

counting circuitry, coupled to said accumulation circuitry, that responds to reception of a plurality of timing control signals and said pluralities of cumulative vertical and horizontal fade interval data signals by providing vertical and horizontal count signals corresponding to respective completions of said cumulative vertical and horizontal OSD fade intervals; and encoding circuitry, coupled to said counting circuitry, that responds to reception of a plurality of OSD window control signals and said vertical and horizontal count signals by providing an OSD fade control signal corresponding to occurrence of said OSD window within said video display.

2. The apparatus of claim 1, wherein:

said fade controller is for providing programmable fade in and fade out rates for said OSD window within said video display;

for vertical fading of said OSD window, said programmable vertical OSD fade interval is shorter than each one of said plurality of cumulative vertical OSD fade intervals during fade in, and said programmable vertical OSD fade interval is longer than each one of said plurality of cumulative vertical OSD fade intervals during fade out; and for horizontal fading of said OSD window, said programmable horizontal OSD fade interval is shorter than each one of said plurality of cumulative horizontal OSD fade intervals during fade in, and said programmable horizontal OSD fade interval is longer than each one of said plurality of cumulative horizontal OSD fade intervals during fade out.

3. The apparatus of claim 1, wherein said accumulation circuitry comprises:

adder circuitry that responds to reception of at least a first one of said plurality of accumulation control signals, said programmable vertical and horizontal fade interval data signals, and said pluralities of cumulative vertical and horizontal fade interval data signals by adding said programmable vertical and horizontal fade interval data signals with corresponding ones of said pluralities of cumulative vertical and horizontal fade interval data signals to provide next ones of said pluralities of cumulative vertical and horizontal fade interval data signals;

multiplexor circuitry, coupled to said adder circuitry, that responds to reception of at least a second one of said plurality of accumulation control signals, said programmable vertical and horizontal fade interval data signals, and said next ones of said pluralities of cumulative vertical and horizontal fade interval data signals by selecting between said programmable vertical and horizontal fade interval data signals and said next ones of said pluralities of cumulative vertical and horizontal fade interval data signals to provide selected vertical and horizontal fade interval data signals; and register circuitry, coupled to said multiplexor circuitry and said adder circuitry, that responds to reception of at least a third one of said plurality of accumulation control signals and said selected vertical and horizontal fade interval data signals by storing said selected vertical and horizontal fade interval data signals to be provided as said pluralities of cumulative vertical and horizontal fade interval data signals.

4. The apparatus of claim 1, wherein said plurality of accumulation control signals comprises:

at least one fade in/out control signal determinative of whether each one of said plurality of cumulative vertical OSD fade intervals is longer or shorter than said programmable vertical OSD fade interval and whether each one of said plurality of cumulative horizontal OSD fade intervals is longer or shorter than said programmable horizontal OSD fade interval;

at least one data selection control signal determinative of when one of said plurality of cumulative vertical OSD fade intervals is equal to said programmable vertical OSD fade interval and when one of said plurality of cumulative horizontal OSD fade intervals is equal to said programmable horizontal OSD fade interval; and at least one interval timing control signal determinative of when successive ones of said plurality of cumulative vertical OSD fade intervals increase or decrease in duration and when successive ones of said plurality of cumulative horizontal OSD fade intervals increase or decrease in duration.

5. The apparatus of claim 1, wherein said counting circuitry comprises:

a first counter that responds to reception of a first portion of said plurality of timing control signals by loading and counting from said plurality of cumulative vertical fade interval data signals to provide said vertical count signals; and a second counter that responds to reception of a second portion of said plurality of timing control signals by loading and counting from said plurality of cumulative horizontal fade interval data signals and to provide said horizontal count signals.

6. The apparatus of claim 1, wherein said plurality of timing control signals comprises:

at least one interval timing control signal determinative of when successive ones of said plurality of cumulative vertical fade interval data signals are used in initiating a vertical count sequence to produce said vertical count signal and when successive ones of said plurality of cumulative horizontal fade interval data signals are used in initiating a horizontal count sequence to produce said horizontal count signal; and at least one count control signal determinative of vertical and horizontal count rates for said vertical and horizontal count sequences, respectively.

7. The apparatus of claim 1, wherein said encoding circuitry comprises:

register circuitry that responds to reception of a portion of said plurality of OSD window control signals by storing said vertical and horizontal count signals; and logic circuitry, coupled to said register circuitry, that logically combines another portion of said plurality of OSD window control signals and said stored vertical and horizontal count signals to provide said OSD fade control signal.

8. The apparatus of claim 1, wherein said plurality of OSD window control signals comprises:

at least one timing control signal determinative of when said vertical and horizontal count signals are encoded with said plurality of OSD window control signals; and at least one OSD enablement signal determinative of when said OSD fade control signal is active.

9. The apparatus of claim 1, further comprising sequencer circuitry, coupled to said accumulation circuitry, said counting circuitry and said encoding circuitry, that responds to reception of a plurality of control signals for said video display by providing said plurality of accumulation control signals, said plurality of timing control signals and said plurality of OSD window control signals.

10. The apparatus of claim 9, wherein said sequencer circuitry comprises:

vertical state machine circuitry, coupled to first respective portions of said accumulation circuitry, said counting circuitry and said encoding circuitry, that responds to reception of a first portion of said plurality of control signals for said video display by providing first respective portions of said plurality of accumulation control signals, said plurality of timing control signals and said plurality of OSD window control signals; and horizontal state machine circuitry, coupled to second respective portions of said accumulation circuitry, said counting circuitry and said encoding circuitry, that responds to reception of a second portion of said plurality of control signals for said video display by providing second respective portions of said plurality of accumulation control signals, said plurality of timing control signals and said plurality of OSD window control signals.

11. An apparatus including a fade controller for providing programmable fade rates for an on-screen display (OSD) window within a video display, comprising:

accumulator means for receiving a plurality of accumulation control signals and respective programmable vertical and horizontal fade interval data signals corresponding to respective programmable vertical and horizontal OSD fade intervals and in response thereto generating respective pluralities of cumulative vertical and horizontal fade interval data signals corresponding to respective pluralities of cumulative vertical and horizontal OSD fade intervals;

counter means for receiving a plurality of timing control signals and said pluralities of cumulative vertical and horizontal fade interval data signals and in response thereto generating vertical and horizontal count signals corresponding to respective completions of said cumulative vertical and horizontal OSD fade intervals; and encoder means for receiving a plurality of OSD window control signals and said vertical and horizontal count signals and in response thereto generating an OSD fade control signal corresponding to occurrence of said OSD window within said video display.

12. The apparatus of claim 11, further comprising sequencer means for receiving a plurality of control signals for said video display and in response thereto generating said plurality of accumulation control signals, said plurality of timing control signals and said plurality of OSD window control signals.

13. A method of fade control for applying programmable fade rates to an on-screen display (OSD) window within a video display, comprising:

vertically fading said OSD window using a programmable vertical OSD interval value corresponding to a vertical dimension of said OSD window; and horizontally fading said OSD window using a programmable horizontal OSD interval value corresponding to a horizontal dimension of said OSD window;

with each of said fadings performed by providing said programmable OSD interval value;

storing said programmable OSD interval value;

enabling said OSD window;

counting during a time interval corresponding to said stored OSD interval value;

disabling said OSD window following termination of said time interval count;

combining said programmable and stored OSD interval values to provide a cumulative OSD interval value;

substituting said cumulative OSD interval value for said stored OSD interval value;

repeating said enabling, counting, disabling, combining and substituting until a predetermined cumulative OSD interval value has been reached.

14. The method of claim 13, wherein said counting during a time interval corresponding to said stored OSD interval value comprises counting down from said stored OSD interval value.

15. The method of claim 13, wherein said counting during a time interval corresponding to said stored OSD interval value comprises counting up from said stored OSD interval value.

16. The method of claim 13, wherein said combining said programmable and stored OSD interval values to provide a cumulative OSD interval value comprises adding said programmable and stored OSD interval values to provide a higher cumulative OSD interval value.

17. The method of claim 13, wherein said combining said programmable and stored OSD interval values to provide a cumulative OSD interval value comprises computing a difference between said programmable and stored OSD interval values to provide a lower cumulative OSD interval value.

18. The method of claim 13, wherein said substituting said cumulative OSD interval value for said stored OSD interval value comprises selecting said cumulative OSD interval value in place of said programmable OSD interval value.

* * * * *